US011697548B2

(12) United States Patent
Dreger

(10) Patent No.: US 11,697,548 B2
(45) Date of Patent: Jul. 11, 2023

(54) SPARK PLUG HOLDER AND ROTATION GUIDE

(71) Applicant: Brian Dreger, Geneva, IL (US)

(72) Inventor: Brian Dreger, Geneva, IL (US)

( * ) Notice: Subject to any disclaimer, the term of this patent is extended or adjusted under 35 U.S.C. 154(b) by 0 days.

(21) Appl. No.: 17/806,583

(22) Filed: Jun. 13, 2022

(65) Prior Publication Data

US 2022/0402687 A1 Dec. 22, 2022

Related U.S. Application Data

(60) Provisional application No. 63/202,445, filed on Jun. 22, 2021.

(51) Int. Cl.
*B65D 85/68* (2006.01)
*B65D 1/36* (2006.01)

(52) U.S. Cl.
CPC ..... *B65D 85/68* (2013.01); *B65D 1/36* (2013.01); *B65D 2585/6875* (2013.01)

(58) Field of Classification Search
None
See application file for complete search history.

(56) References Cited

U.S. PATENT DOCUMENTS

| | | | |
|---|---|---|---|
| 1,434,338 | A | 10/1922 | Grose |
| 4,512,297 | A | 4/1985 | Ichikawa et al. |
| 4,807,747 | A | 2/1989 | Hadtke |
| 7,665,452 | B2 | 2/2010 | Russell et al. |
| 2018/0044061 | A1 | 2/2018 | Tourtellotte |

*Primary Examiner* — Bryon P Gehman
(74) *Attorney, Agent, or Firm* — Dunlap Bennett & Ludwig, PLLC

(57) ABSTRACT

A device for holding and guiding rotation of aircraft spark plugs is herein disclosed. The device includes a main body, openings defined in the main body, characters of text disposed on a top surface of the main body, and guide lines. Each opening is sized to receive one of the spark plugs. Each character of text is positioned adjacent a respective opening of the openings. Further, each guide line runs from one opening to another opening to serve as a guide for rotating the spark plugs.

10 Claims, 4 Drawing Sheets

SPARK PLUG HOLDER AND ROTATION GUIDE

CROSS-REFERENCE TO RELATED APPLICATION

This application claims the benefit of priority of U.S. provisional application No. 63/202,445, filed Jun. 11, 2021, the contents of which are herein incorporated by reference.

BACKGROUND OF THE INVENTION

The present invention relates to engine spark plugs and, more particularly, to a spark plug holder tray and rotation guide for airplane piston engines.

Airplane engine spark plugs need to be rotated between cylinders regularly to extend the life of the spark plug. Available airplane spark plug tray devices on the market do not depict the physical orientation of the cylinders in relation to the engine. These devices also do not depict the spark plug rotation sequence (e.g., cylinder number+top and bottom).

Other devices do not work well for most individuals, as users thereof must have a prior understanding of cylinder number in relation to the physical orientation of the airplane engine. Also, the user must have prior knowledge of the correct rotation order (e.g., cylinder number+top or bottom).

As can be seen, there is a need for a device that retains airplane engine spark plugs and provides a guide for their rotation.

SUMMARY OF THE INVENTION

In one aspect of the present invention, a device for holding and guiding rotation of a plurality of spark plugs is disclosed, with the device comprising: a main body; a plurality of openings defined in the main body, each opening being sized to receive one of the plurality of spark plugs; a plurality of characters of text disposed on a top surface of the main body, each character of text being positioned adjacent a respective opening of the plurality of openings; and a plurality of guide lines, each guide line running from one opening of the plurality of openings to another opening of the plurality of openings.

These and other features, aspects and advantages of the present invention will become better understood with reference to the following drawings, description, and claims.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, without departing from the scope of this disclosure.

DETAILED DESCRIPTION OF THE INVENTION

Figure 1:
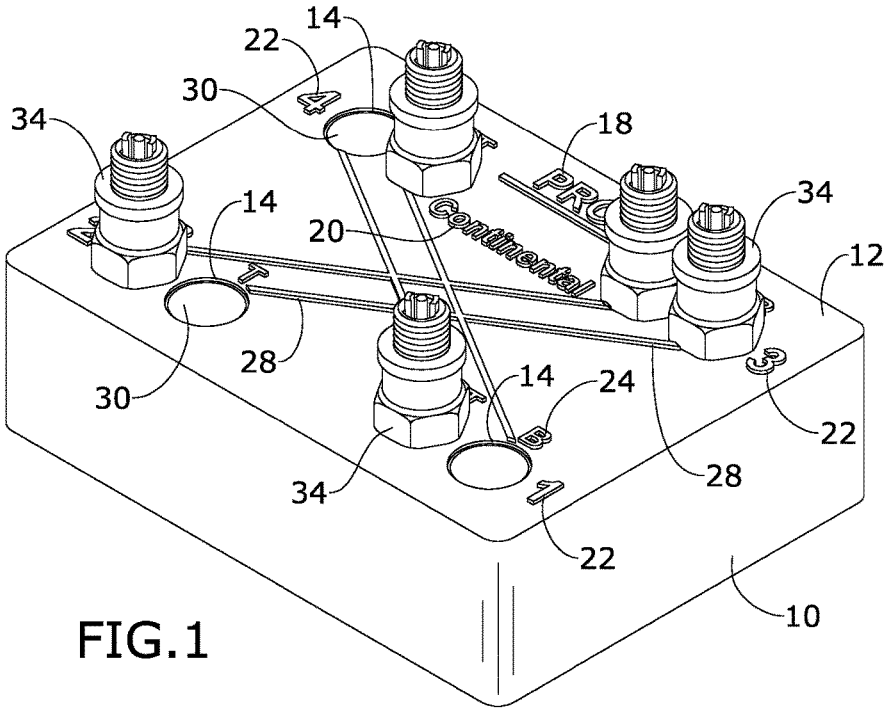
FIG. 1 is a perspective view of an embodiment of the present invention, shown in use.

The subject disclosure is described with reference to the drawings, wherein like reference numerals are used to refer to like elements throughout. In the following description, for purposes of explanation, numerous specific details are set forth in order to provide a thorough understanding of the present disclosure such that one skilled in the art will be enabled to make and use the present invention. It may be evident, however, that the present disclosure may be practiced without some of these specific details. For the purpose of clarity, technical material that is known in the technical fields related to the present invention has not been described in detail so that the present invention is not unnecessarily obscured.

Broadly, an embodiment of the present invention provides a spark plug holder and rotation guide device comprising a plurality of openings configured to receive spark plugs, text on a top surface of the device adjacent the openings, and guide lines connecting corresponding openings to indicate where spark plugs should be re-located, as shown and described.

In accordance with certain aspects of the present invention, a spark plug holder tray is provided that serves as a device to organize the plugs as they are removed and then provide a visual guide to which cylinder the plug should be rotated to when re-installed. Embodiments of the present invention provide the user a reference to the cylinder numbering and proper rotation order.

The spark plug tray differs from existing spark plug trays in, such as but not limited to, two important ways: 1) the physical orientation (left or right side+top or bottom) is depicted on the tray; and 2) the proper rotation sequence is depicted on the tray.

Referring now to FIGS. 1-9, a device 10 (which may be formed form plastic) with openings 14 for plugs 34 defines a main body (which may be cuboid in shape) of the embodiments described herein. Raised text 18, 20, 22, 24, 26 is provided on a top surface 12 of the device 10.

Figure 2:
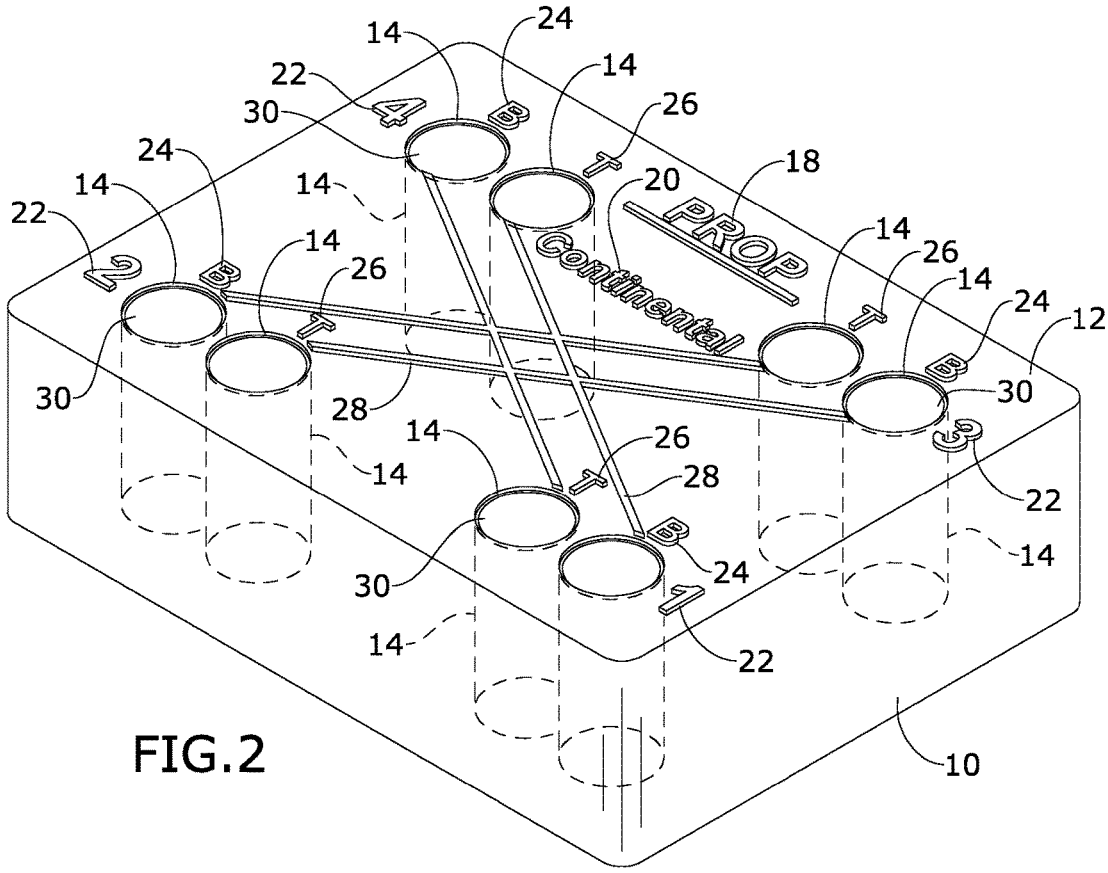
FIG. 2 is a top perspective view of the embodiment of the present invention.
Figure 3:
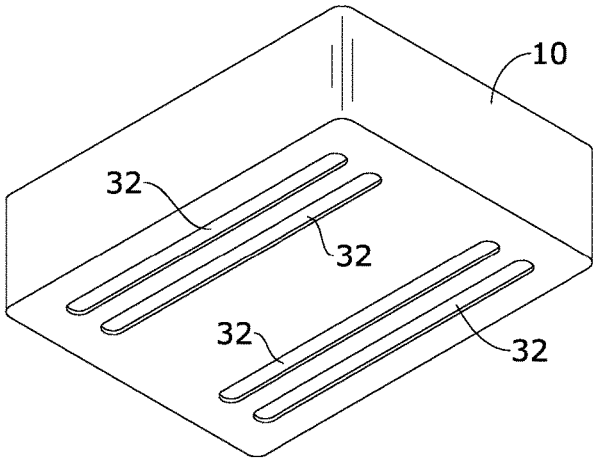
FIG. 3 is a bottom perspective view of the embodiment of the present invention.

As shown in FIG. 2, the raised text are characters in the forms of letters (e.g., a B-label 24 and T-label 26) and numbers 22. These different types of raised text are used to identify the cylinder number (with the number labels 22), top or bottom plug (with T-labels 26 and B-labels 24, respectively), engine manufacturer (with manufacturer raised text 20), aircraft type 18, and orientation. Raised line connectors 28 (also referred to as "guide lines") are provided to serve as a visual guide for rotating the spark plugs 34 (i.e., the guide line indicates where the currently placed spark plug 34 should be moved). As shown, these guide lines 28 run between respective sets of oppositely disposed openings 14. In the first illustrated embodiment, there are eight openings 14 and, thus, four guide lines 28.

Referring to FIGS. 4-8, flexible inserts 30 (made from, for example, plastic) may also provided within the openings 14 to hold the plugs 34 securely in place. The flexible plastic inserts 34 may be optionally provided and could be removed in embodiments where the openings 14 have a smaller diameter to compensate for the wall thickness of the inserts 34.

In use with a piston airplane engine, a user 36 removes two spark plugs 34 from each cylinder (not shown). As each plug 34 is removed, the user 36 references the hole orientation on the device 10 (which directly corresponds to the layout of the engine cylinder) and then places each plug 34 in the corresponding hole 14 of the device 10. When all the plugs 34 have been removed from the engine, the user 36 can then follow the rotation lines 28 to intuitively determine where to reinstall the plugs 34 into the new, appropriate cylinder at a top or bottom location.

Figure 4:
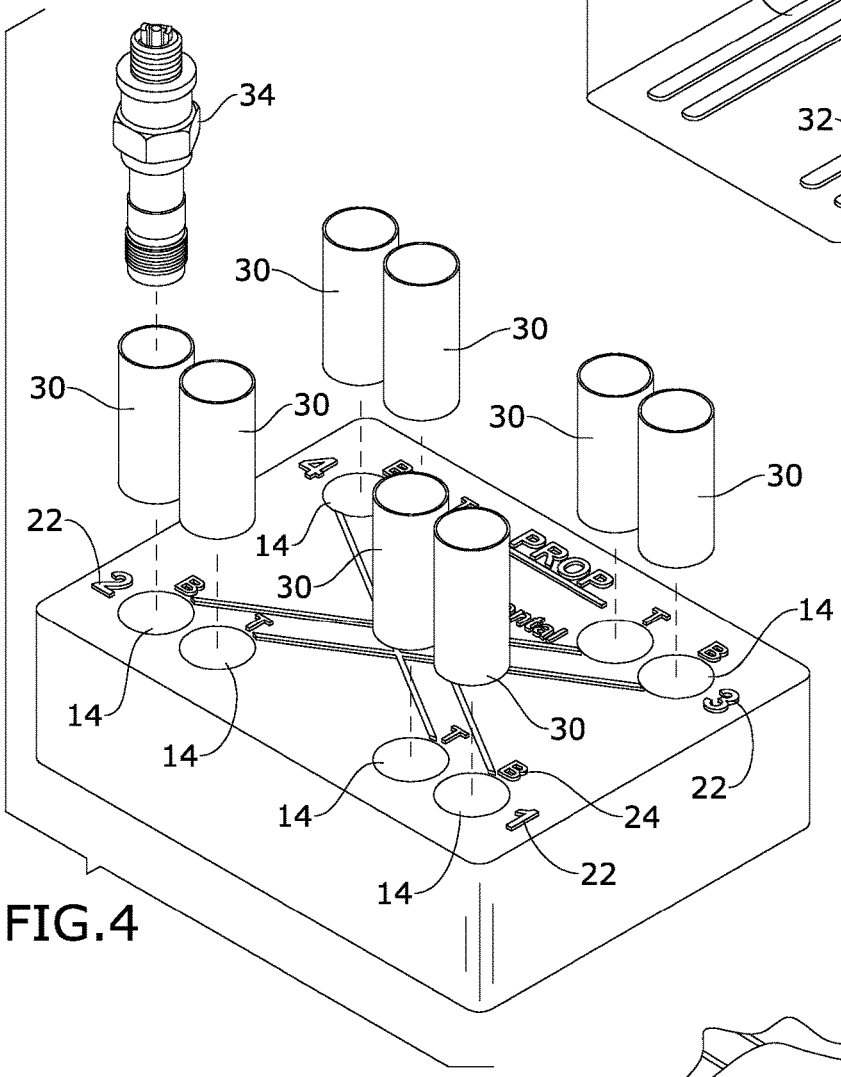
FIG. 4 is an exploded view of the embodiment of the present invention.
Figure 5:
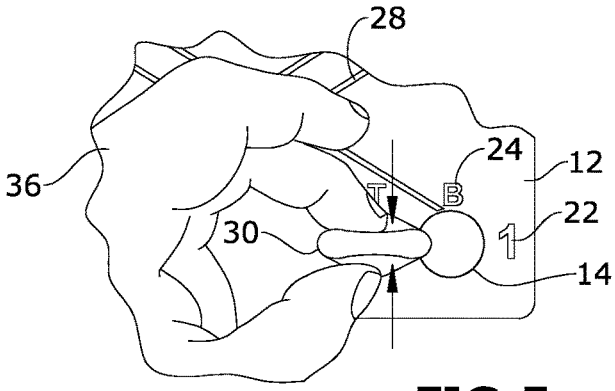
FIG. 5 is a top view of the embodiment of the present invention, showing the malleability of inserts for insertion into slots.
Figure 6:
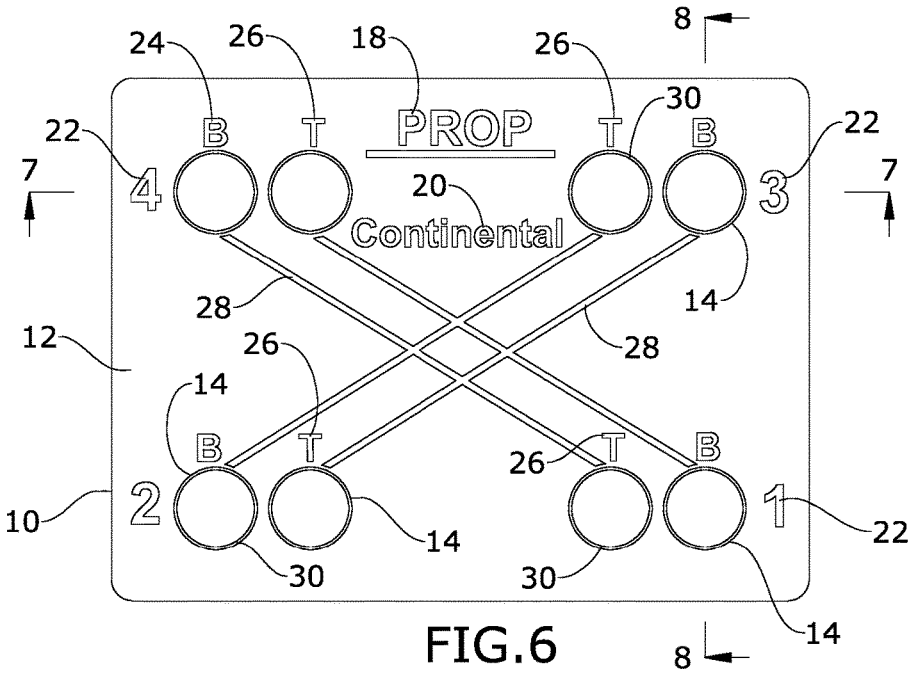
FIG. 6 is a top view of the embodiment of the present invention.
Figure 7:
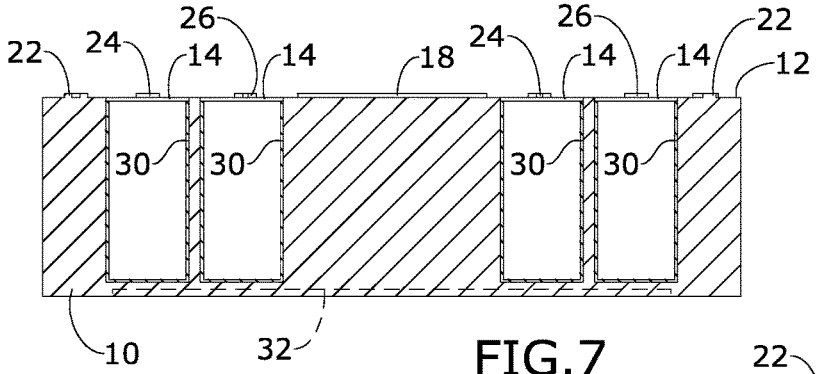
FIG. 7 is a section view of the embodiment of the present invention, taken along line 7-7 in FIG. 6.
Figure 8:
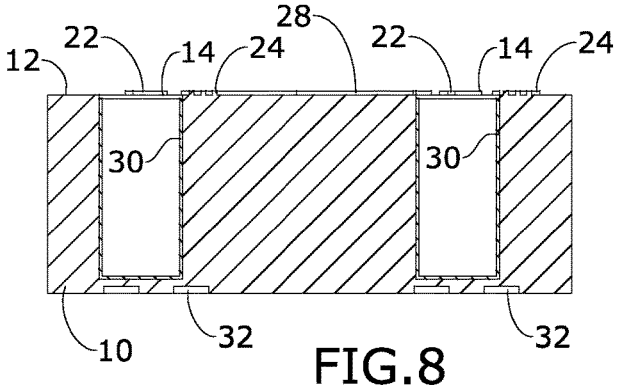
FIG. 8 is a section view of the embodiment of the present invention, taken along line 8-8 in FIG. 6.
Figure 9:
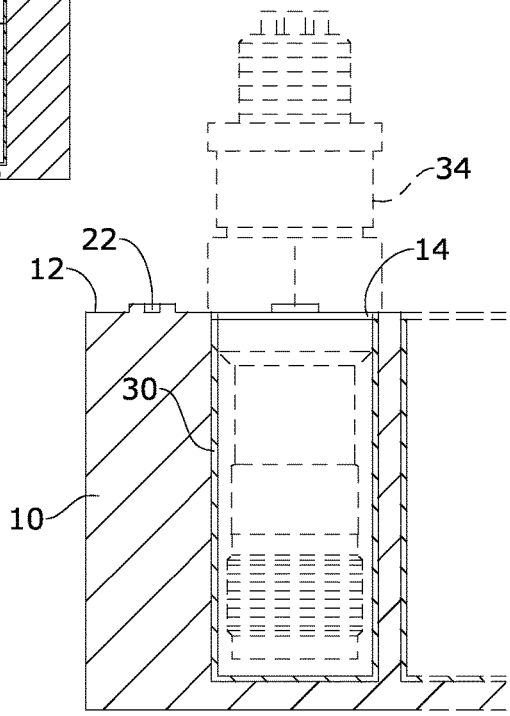
FIG. 9 is a detail section view of the embodiment of the present invention.

By way of example, a spark plug 34 initially placed into the bottom left opening 14 shown in FIG. 4 (labeled 2B) would be repositioned to the upper right corner opening labeled 3T. After all the spark plugs 34 are moved to their new appropriate location on the device 10, they can be reinserted into the engine cylinder with their new positioning.

Figure 10:
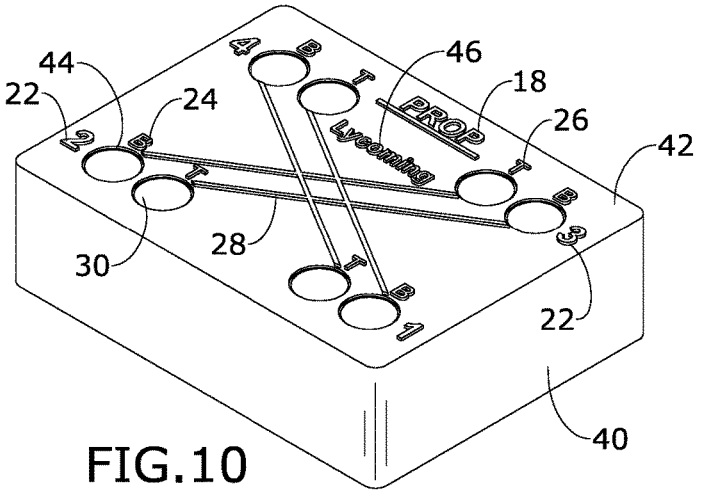
FIG. 10 is a perspective view of an alternate embodiment of the invention.
Figure 11:
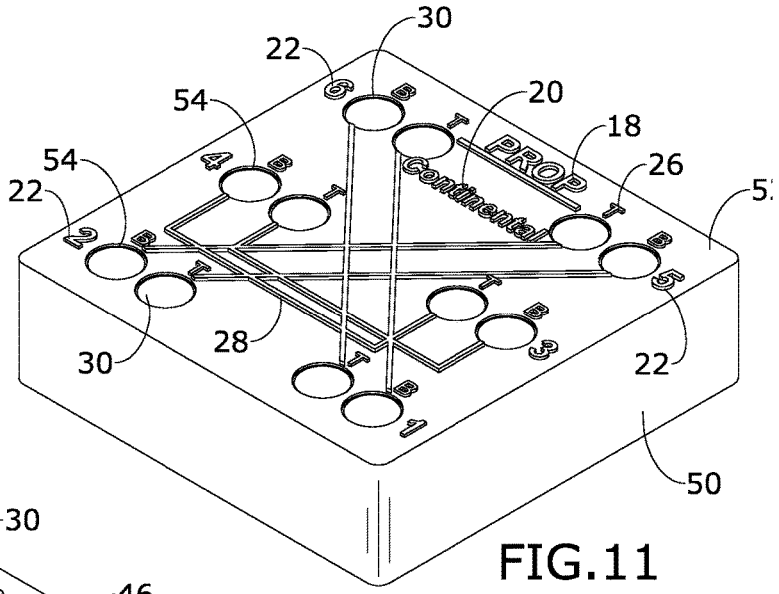
FIG. 11 is a perspective view of an alternate embodiment of the invention.
Figure 12:
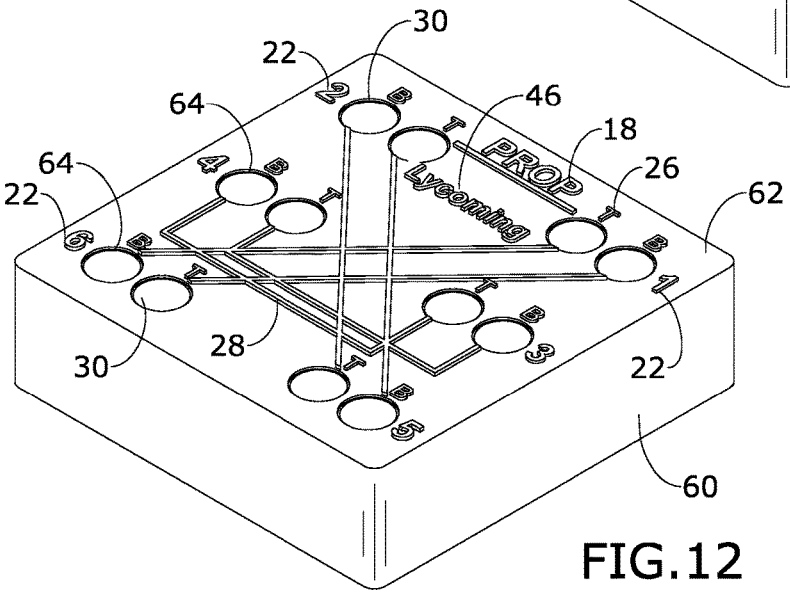
FIG. 12 is a perspective view of an alternate embodiment of the invention.

FIGS. 10-12 depict alternative embodiments of the present invention. In each embodiment, the concepts described above are largely the same, they are simply adapted to different airplane engine makes and models (which have different layouts of spark plugs 34). As shown in FIG. 10, second device 40 may include a second top surface 42 with second openings 44. This device 40 includes alternative manufacturer raised text 46 that corresponds to a different manufacturer from the previously described one, but an otherwise similar layout. As shown in FIG. 11, in another embodiment, a third device 50 with a third top surface 52 may include manufacturer raised text 20 that is the same as the first embodiment, but an overall configuration of the openings 54 and the lines 28 connecting them may change (e.g., there are twelve openings 54 in this embodiment). FIG. 12 serves to further reinforce the previous two examples. A fourth device 60 may include a fourth top surface 62 with openings 64 similar in layout to the third device, but with a different manufacturer (the manufacturer referenced in the second embodiment). As is readily apparent, many configurations may be employed that result in a different look, but offer the same advantages and functionality for different engine cylinders.

Various methods may be employed to make embodiments of the present invention, such as three-dimensional (3D) printing with a variety of available plastics. One could also make this product through an injection molded process.

A method of using the present invention may include the following. In a piston airplane engine, a user removes two spark plugs 34 from each cylinder. As each plug 34 is removed, the user references the hole orientation on the holder 10 to then place each plug 34 in the corresponding hole 14 in the tray 10. When all plugs 34 have been removed from the engine, the user follows the rotation guide lines 28 to reinstall the plugs 34 into the correct new cylinder number and top or bottom location.

While one or more preferred embodiments are disclosed, many other implementations will occur to one of ordinary skill in the art and are all within the scope of the invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. Other arrangements, methods, modifications, and substitutions by one of ordinary skill in the art are therefore also considered to be within the scope of the present invention, which is not to be limited except by the claims that follow.

While apparatuses and methods are described in terms of "comprising," "containing," or "including" various components or steps, the apparatuses and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted. Moreover, the use of directional terms such as above, below, upper, lower, upward, downward, left, right, and the like are used in relation to the illustrative embodiments as they are depicted in the figures, the upward or upper direction being toward the top of the corresponding figure and the downward or lower direction being toward the bottom of the corresponding figure.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A device for holding and guiding rotation of a plurality of spark plugs, the device comprising:

a main body;

a plurality of openings defined in the main body, each opening being sized to receive one of the plurality of spark plugs;

a plurality of characters of text disposed on a top surface of the main body, each character of text being positioned adjacent a respective opening of the plurality of openings; and a plurality of guide lines, each guide line running from one opening of the plurality of openings to another opening of the plurality of openings.

2. The device of claim 1, wherein the main body is cuboid-shaped.

3. The device of claim 1, wherein the plurality of openings comprises at least eight openings.

4. The device of claim 3, wherein the plurality of openings is comprised of pairs of oppositely disposed openings.

5. The device of claim 1, wherein the plurality of characters of text comprises numbers and letters.

6. The device of claim 5, wherein the letters are B and T.

7. The device of claim 6, wherein each guide line runs from an opening of the plurality of openings with the letter B adjacent thereto to another opening of the plurality of openings with the letter T adjacent thereto.

8. The device of claim 5, wherein the numbers are at least the numbers one, two, three, and four, the numbers indicating a cylinder number of an airplane engine.

9. The device of claim 1, wherein the plurality of guide lines comprises at least four guide lines.

10. The device of claim 1, further comprising an aircraft type label or engine manufacturer label disposed on the main body.

* * * * *